US009844099B2

(12) United States Patent
Yun et al.

(10) Patent No.: US 9,844,099 B2
(45) Date of Patent: Dec. 12, 2017

(54) INDUCTION HEATING APPARATUS

(71) Applicant: SAMSUNG ELECTRONICS CO., LTD., Suwon-si, Gyeonggi-do (KR)

(72) Inventors: Chang Sun Yun, Suwon (KR); Ki Hyeon Park, Pyeongtaek-si (KR); Chung-Wook Roh, Seoul (KR); Sang Eon Kim, Bucheon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 269 days.

(21) Appl. No.: 14/509,637

(22) Filed: Oct. 8, 2014

(65) Prior Publication Data

US 2015/0201467 A1 Jul. 16, 2015

(30) Foreign Application Priority Data

Jan. 14, 2014 (KR) ..... 10-2014-0004805

(51) Int. Cl.
*H05B 6/12* (2006.01)
*H05B 6/06* (2006.01)
*H05B 6/04* (2006.01)

(52) U.S. Cl.
CPC ..... *H05B 6/062* (2013.01); *H05B 6/04* (2013.01); *H05B 2213/03* (2013.01); *H05B 2213/05* (2013.01)

(58) Field of Classification Search
CPC ..... H05B 2213/00; H05B 2213/03; H05B 2213/05; H05B 6/02–6/062; H05B 6/12–6/1236
USPC ..... 219/620–627
See application file for complete search history.

(56) References Cited

U.S. PATENT DOCUMENTS 4,764,652 A * 8/1988 Lee ..... H05B 6/062 219/626
5,248,866 A * 9/1993 Tanaka ..... H05B 6/062 219/624
5,319,174 A * 6/1994 Omori ..... H02M 7/53803 219/625
2013/0164013 A1* 6/2013 Kondo ..... G03G 15/2039 399/67

FOREIGN PATENT DOCUMENTS

KR 10-2012-0069513 6/2012
KR 10-2013-0067224 6/2013

* cited by examiner

*Primary Examiner* — Sang Y Paik
(74) *Attorney, Agent, or Firm* — Staas & Halsey LLP

(57) ABSTRACT

An induction heating apparatus in accordance with the present disclosure includes a coil; an inverter unit configured to have a switching device turned on and off to supply power to the coil; a first controller configured to generate a first threshold current based on information about a coil current flowing in the coil and an input voltage applied to the coil, and generate a clock signal by comparing the coil current with the first threshold current; and a switch driver configured to generate a switch driving signal to turn on or off the switching device of the inverter unit by dividing a frequency of the clock signal.

21 Claims, 12 Drawing Sheets

INDUCTION HEATING APPARATUS

CROSS-REFERENCE TO RELATED APPLICATIONS

This application claims the benefit of Korean Application No. 10-2014-0004805, filed Jan. 14, 2014, in the Korean Intellectual Property Office, the disclosure of which is incorporated herein by reference.

BACKGROUND

1. Field

Embodiments of the present disclosure relate to an induction heating apparatus with an inverter.

2. Description of the Related Art

In comparison with conventional gas burners and oil burners having been used as heaters, the induction heating apparatus has short heating time which leads to less possibility for deformation by heat, and causes self-heating which leads to high efficiency, thereby enabling an entire system to be compact in size and light in weight. Modern high-frequency induction heating apparatuses have a trend to be implemented digitally taking into account protection of switching devices and improved reliability and accuracy. Recent development of power semiconductors, such as Insulated Gate Bipolar mode Transistors (IGBTs), Integrated Gate-Commutated Thyristors (IGCTs), Silicon Controlled Rectifiers (SCRs), Metal-Oxide Semiconductor Field Effect Transistors (MOS-FETs) has enabled resonant converters and inverters in need of high frequency switching to be designed.

The induction heating apparatus is largely divided into two different types. First, there is an induction heating apparatus with a voltage source inverter. The voltage source inverter type induction heating apparatus regulates an output by changing a switching frequency and performs switching at a higher frequency than a desired resonance frequency in a way to draw reactive power from within a resonance circuit. This provides an advantage of decreased reactive power due to the phase delay of a current with respect to a supply voltage and attainment of zero-voltage switching in an automatic turning on phase by using load resonance and switching the load at a frequency higher than the resonance frequency.

However, power loss increases as the switching frequency becomes higher. Accordingly, to reduce the power loss, a circuit, instead of an auxiliary circuit is required or a switching scheme, instead of the zero-voltage switching scheme, for reducing stress on the power semiconductor devices is required.

In contrast, the second type induction heating apparatus uses a high-frequency half-bridge inverter that has advantages of attaining the zero-voltage switching and having low voltage power semiconductors, by nature of the half-bridge scheme, thereby being easily expandable and thus having been widely used in induction heating systems. With the high-frequency half-bridge type inverter, fast heating may be achieved with high reliability, easy control over outputs and temperature, and less pollutants resulting from the heating procedure, thereby securing better heating efficiency, less heat loss and more clean surroundings.

Such an induction heating apparatus of a related art may include an RLC load block having e.g., inductance L from a coil for induction heating, resistance R of an object to be heated, capacitance C of a power factor compensative condenser, and main technologies of the heating induction apparatus are to find a resonance frequency to make impedance and admittance of the RLC load block minimum and thus to supply power to the load at an optimum power efficiency. In other words, it is an important factor that a resonance state is maintained even if the object to be heated (e.g., a pot, a vessel, etc.) has been moved due to a manipulation by a user at the beginning of driving the induction heating apparatus or during heating.

To do this, the induction heating apparatus of the related art measures RLC of a fixed load to select a suitable resonance frequency and performs non-changeable switching for the inverter. That is, since the switching signal sent to the inverter has a fixed resonance frequency, it is difficult to actively react to a situation changed with a change in load state and thus heating efficiency may degrade significantly. In other words, if there is a change in the RCL value due to various factors, resonance frequency deviation may occur and thus induction heating may not work at a maximum efficiency.

In addition, even a change in electrical characteristics due to the load in the induction heating apparatus may require a phase difference between voltage and current applied to a coil to be increased for robust current control, and in this case a switch turn-off current may increase, thereby increasing switching loss.

SUMMARY

Additional aspects and/or advantages will be set forth in part in the description which follows and, in part, will be apparent from the description, or may be learned by practice of the invention.

To address the problem, an objective of embodiments of the present disclosure is to implement optimum switching operations so as to minimize a phase difference between voltage and current applied to a coil and reduce switching losses.

In accordance with an aspect of the present disclosure, an induction heating apparatus is provided. The induction heating apparatus includes a coil; an inverter unit configured to have a switching device turned on and off to supply power to the coil; a controller configured to generate a threshold current based on information about a coil current flowing in the coil and an input voltage applied to the coil, and to generate a clock signal by comparing the coil current with the threshold current; and a switch driver configured to generate a switch driving signal to turn on or off the switching device of the inverter unit by dividing a frequency of the clock signal. A resonance point tracking controller and a switch driver may be implemented by a micom.

High level intervals of the clock signal may be made in intervals where the coil current is less than the threshold current.

The controller may include a comparator, wherein the comparator has magnitude information of the coil current at its inverting input and has the threshold current at its non-inverting input.

The threshold current may be determined to be proportional to a peak value of the coil current divide by the input voltage.

The threshold current may be determined to have a magnitude to keep turn-off current of the switching device minimum.

The switch driver may include a D flip-flop having the clock signal input to its clock input and a negative logic output connected to its data input; and a logic gate configured to generate a switch driving signal to drive the switching device of the inverter unit using a positive logic output and the negative logic output of the D flip-flop.

The logic gate may include an AND gate for generating the switch driving signal by dividing a frequency of the positive logic output of the D flip-flop approximately by two.

The inverter unit may comprise a half-bridge inverter.

The controller and the switch driver may constitute a half-bridge inverter implemented by a micom.

In accordance with another aspect of the present disclosure, an induction heating apparatus is provided. The induction heating apparatus includes a coil; an inverter unit configured to have a switching device turned on and off to supply power to the coil; a first controller configured to generate a first threshold current based on information about a coil current flowing in the coil and an input voltage applied to the coil, and to generate a clock signal by comparing the coil current with the first threshold current; a switch driver configured to generate a switch driving signal to turn on or off the switching device of the inverter unit by dividing a frequency of the clock signal; and a second controller configured to generate an enable signal for selectively restricting input of the clock signal to the switch driver based on output information set by a user, when the clock signal output from the first controller is input to the switch driver.

High level intervals of the clock signal may be made in intervals where the coil current is less than the first threshold current.

The first controller may include a first comparator, wherein the first comparator has magnitude information of the coil current at its inverting input and has the first threshold current at its non-inverting input.

The first threshold current may be determined to be proportional to a peak value of the coil current divide by the input voltage.

The first threshold current may be determined to have a magnitude to keep turn-off current of the switching device minimum.

The switch driver may include a D flip-flop having the clock signal input to its clock input and a negative logic output connected to its data input; and a logic gate configured to generate a switch driving signal to drive the switching device of the inverter unit using a positive logic output and the negative logic output of the D flip-flop.

The logic gate may include an AND gate for generating the switch driving signal by dividing a frequency of the positive logic output of the D flip-flop approximately by two.

The inverter unit may comprise a half-bridge inverter.

The second controller may include a second comparator, and wherein the second comparator has a Proportional Integral (PI) control value resulting from PI control over a difference between an absolute value of the coil current and a second threshold current at its non-inverting input, and has a sawtooth wave signal at its non-inverting input.

The second threshold current may represent a target output of the induction heating device set by a user.

The second controller may generate a pulse signal as the enable signal having a high level value for intervals where the PI control value is greater than the sawtooth wave signal and a low level value for intervals where the PI control value is equal to or less than the sawtooth wave signal.

A frequency of the clock signal may be divided in the switch driver in the high level intervals of the enable signal.

The first controller, the switch driver, and the second controller may constitute a half-bridge inverter implemented by a micom.

In accordance with a further aspect of the present disclosure, an induction heating apparatus includes a coil; an inverter unit configured to have a switching device turned on and off to supply power to the coil; a controller configured to generate a threshold current based on information about a coil current flowing in the coil and an input voltage applied to the coil, and to generate a clock signal by comparing the coil current with the threshold current; and a switch driver configured to generate a switch driving signal to turn on or off the switching device of the inverter unit by dividing a frequency of the clock signal.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

The above and other features and advantages of the present disclosure will become more apparent by describing in detail exemplary embodiments thereof with reference to the attached drawings in which.

Throughout the drawings, like reference numerals will be understood to refer to like parts, components, and structures.

DETAILED DESCRIPTION

Figure 1:
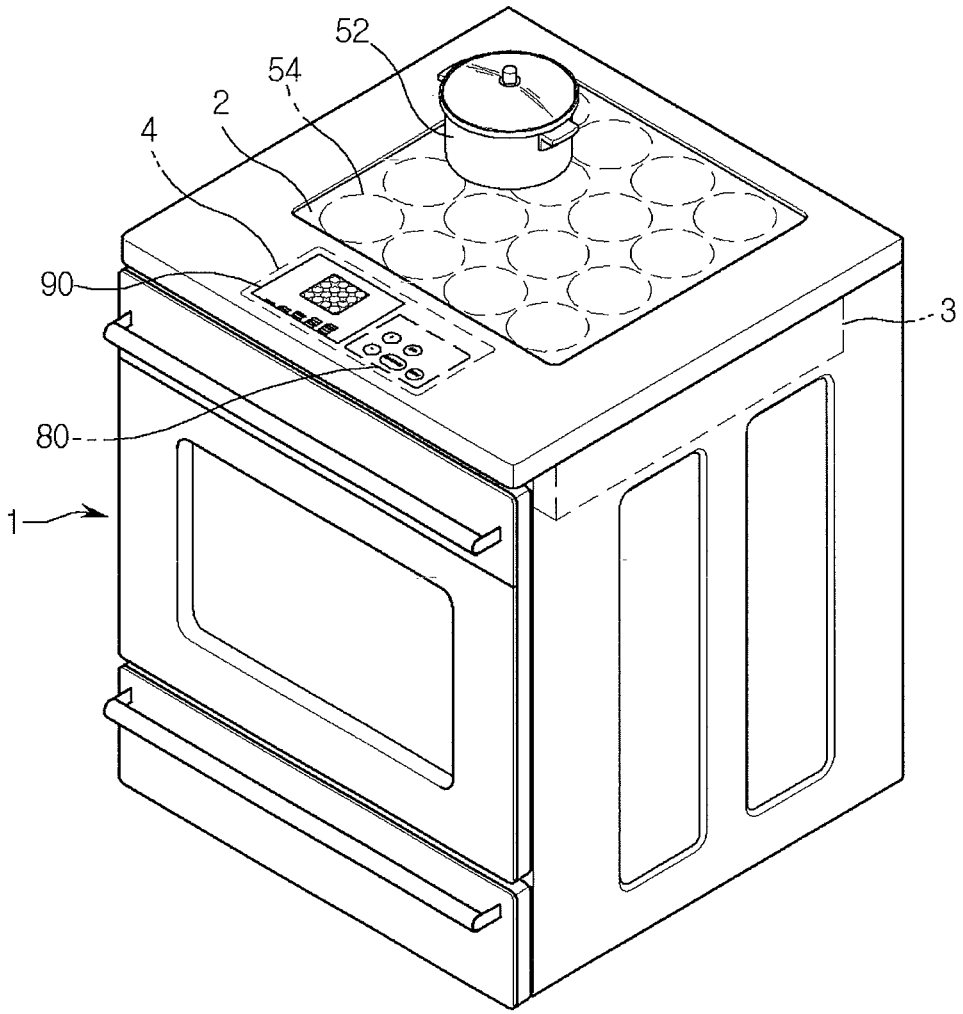
FIG. 1 is a perspective view of an induction heating cooker, according to an embodiment of the present disclosure.

The present disclosure will now be described more fully with reference to the accompanying drawings, in which exemplary embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art. Like reference numerals in the drawings denote like elements, and thus their description will be omitted.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure. The terminology used herein is for the purpose of describing particular embodiments only and is not intended to be limiting of the invention. It is to be understood that the singular forms "a," "an," and "the" include plural references unless the context clearly dictates otherwise.

The term "include (or including)" or "comprise (or comprising)" is inclusive or open-ended and does not exclude additional, unrecited elements or method steps. "Unit", "module", "block", etc. used herein each represent a unit for handling at least one function or operation, and may be implemented in hardware, software, or a combination thereof.

In the following description, various embodiments of an induction heating apparatus are provided with reference to FIGS. 1 to 12. While embodiments of FIGS. 1 to 12 illustrate an induction heating cooker as an example of an induction heating apparatus, the embodiments of the present disclosure are not limited to the cooker, but may also be applied in various industrial fields that use induction heating, such as a heating apparatus for heating a toner in a fuser of a printer, a heat processing apparatus for metal surface reinforcement.

FIG. 1 is a perspective view of an induction heating cooker, according to an embodiment of the present disclosure. Referring to FIG. 1, the induction heating cooker 1 may include a main body 1. On the top of the main body 1, a cooking plate 2 may be prepared to have a cooking vessel 52 put thereon. The cooking vessel 2 may be made of ceramic materials. Inside the main body 1 and under the cooking plate 2, a plurality of coils 54 may be prepared to serve heat sources for the cooking plate 2. The coils 54 may be equally spaced under and across the entire area of the cooking plate 2. In the embodiment of FIG. 1, 16 coils 54 are arranged in 4×4 matrix form. However, unlike this embodiment, the coils 54 may not be equally spaced under and across the entire area of the cooling plate 2 in other embodiments. Under the cooking plate, a control unit 3 is also prepared to drive the coils 54. A control panel 4 is prepared atop the main body 1 and may include an input unit 80 for receiving a command from a user and delivering the command for the control unit 3 to drive the coils 54 and a display 90 for displaying information regarding works of the induction heating cooker.

Figure 2:
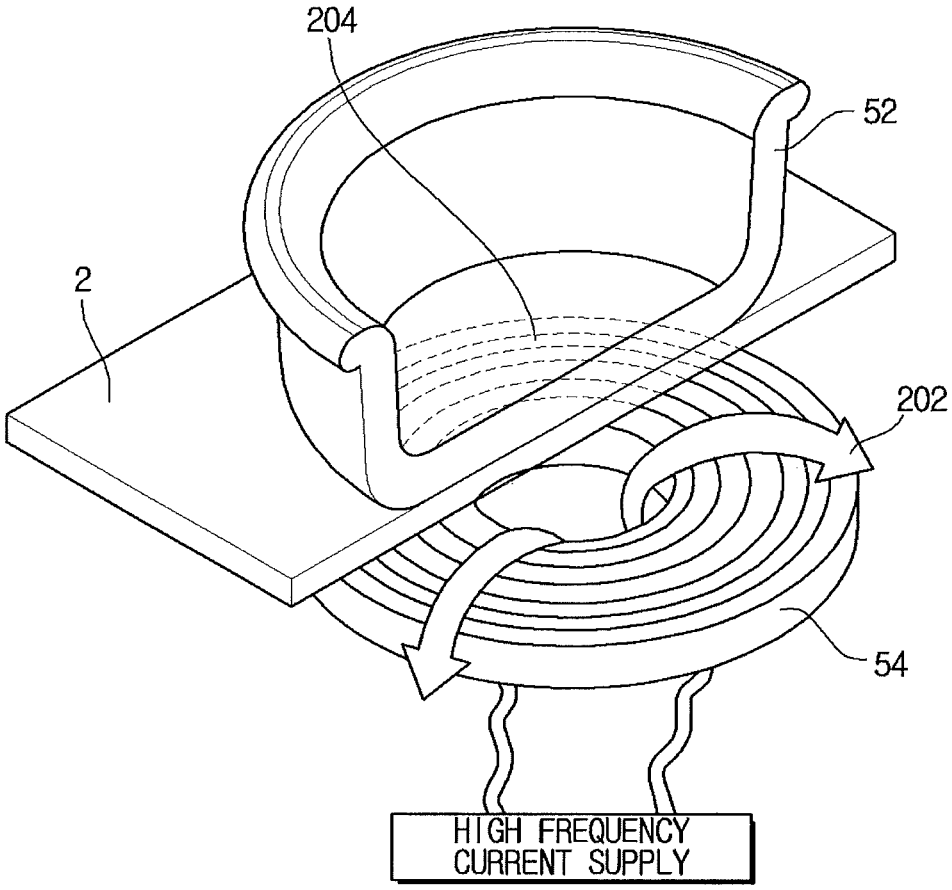
FIG. 2 illustrates a structure of a coil of the induction heating cooker of FIG. 1.

FIG. 2 illustrates a structure of a coil of the induction heating cooker of FIG. 1. Referring to FIG. 2, one of the coils (briefly called 'the coil 54') is prepared under the cooking plate 2 in a helical form and electrically connected to a high frequency power supply 206. The high frequency power supply 206 may apply high frequency current to the coil 54.

A cooking vessel 52 containing some food may be put on the top of the cooking plate 2. When the high frequency current is applied to the coil 54 while the induction heating cooker is in operation, magnetic fields are produced in a direction as represented by 202 and the magnetic fields cause induced current, i.e., eddy current as represented by 204 to be generated on the bottom of the cooking vessel 52 on the cooking plate 2.

Figure 3:
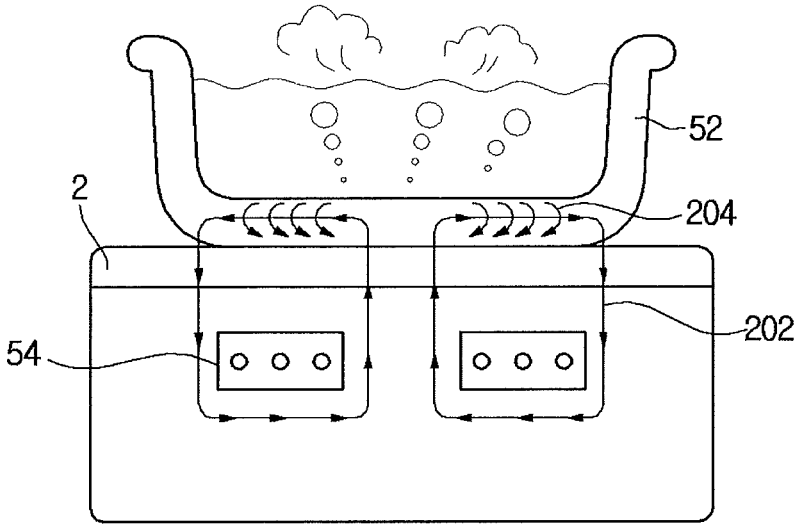
FIG. 3 illustrates a heating principle of the induction heating cooker of FIG. 1.

FIG. 3 illustrates a heating principle of the induction heating cooker of FIG. 1. The induction heating cooker heats the food inside the cooking vessel 52 using electric resistance and the eddy current generated by the Faraday's law.

Turning back to FIG. 2, it has been discussed that the high frequency current flowing in the coil 54 produces magnetic fields around the coil 54 and the magnetic fields induces the eddy current on the bottom of the cooking vessel 52. The high frequency current may have a frequency in a range from about 20 kHz to about 35 kHz. If the cooking vessel 52 made of a metal is located within a coverage affected by the magnetic fields produced around the coil 54, the magnetic fields penetrates the bottom of the cooking vessel 52 and induces the eddy current by the Faraday's law. Interaction of the eddy current and the electric resistance of the cooking vessel 52 leads to Joule heating of the cooking vessel 52, which may heat the food contained in the cooking vessel 52. In this regard, since the cooking vessel 52 serves as a heating source itself, it may be made of a metal material, such as iron, stainless steel, nickel, etc. However, aluminum, ceramic, or glass may not suitable for the cooking vessel 52 used with the induction heating apparatus because such materials have little electrical resistance and are not easily heated.

Figure 4:
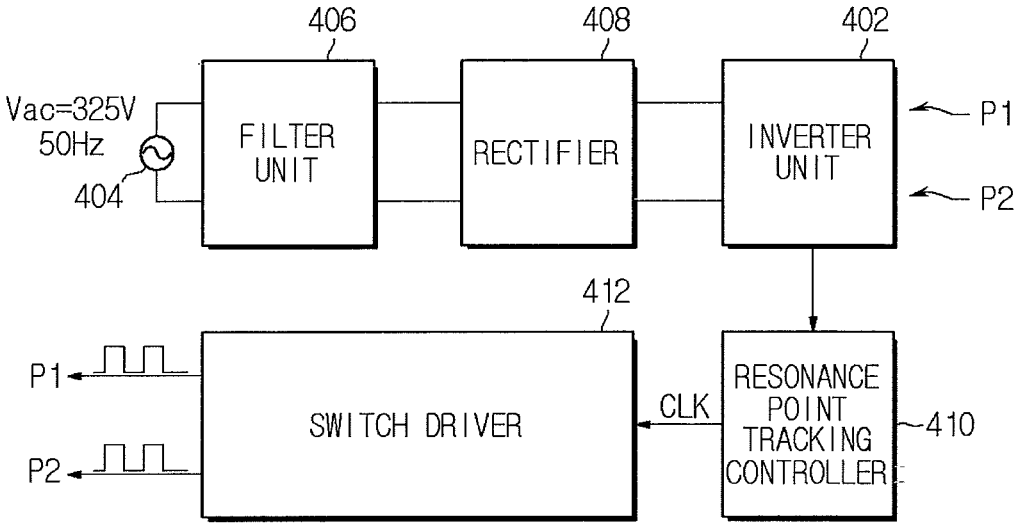
FIG. 4 a block diagram of a high frequency power supply of the induction heating cooker of FIG. 1, according to an embodiment of the present disclosure.

FIG. 4 a block diagram of a high frequency power supply of the induction heating cooker of FIG. 1, according to an embodiment of the present disclosure. Referring to FIG. 4, an inverter unit 402 may include the coil 54 as shown in FIGS. 2 and 3. When Alternate Current (AC) power from an AC power source 404 is supplied to the coil 54 of the inverter unit 402 through a filter unit 406 and a rectifier 408, a resonance point tracking controller 410 (or called a 'first controller') and a switch driver 412 may be involved in supplying power to the inverter unit 402 in order to minimize a power loss that is likely to occur in the inverter unit 402.

As shown in FIG. 4, the AC power source 404 may supply common AC power with e.g., a voltage of 325V and a frequency of 50 Hz. The common AC power supplied from the AC power source 404 may go through noise cancellation in the filter unit 406, and then delivered to the rectifier 408. The rectifier 408 may rectify the AC power to DC power, and the DC power is delivered to the inverter unit 402. The inverter unit 402 may convert the DC power to high frequency (AC) power by switching operations, and the high frequency power is applied to the coil 54.

The resonance point tracking controller 410 may control the switch driver 412 to minimize the power loss by optimizing the switching operations for supplying power to the coil 54 even if some electrical parameters (e.g., equivalent inductance and equivalent resistance) of the coil 54 change. The switch driver 412 may generate and provide switch driving signals P1 and P2 for the inverter unit 402 to perform switching operations. The inverter unit 402 may perform the switching operations with the switch driving signals P1 and P2.

Figure 5:
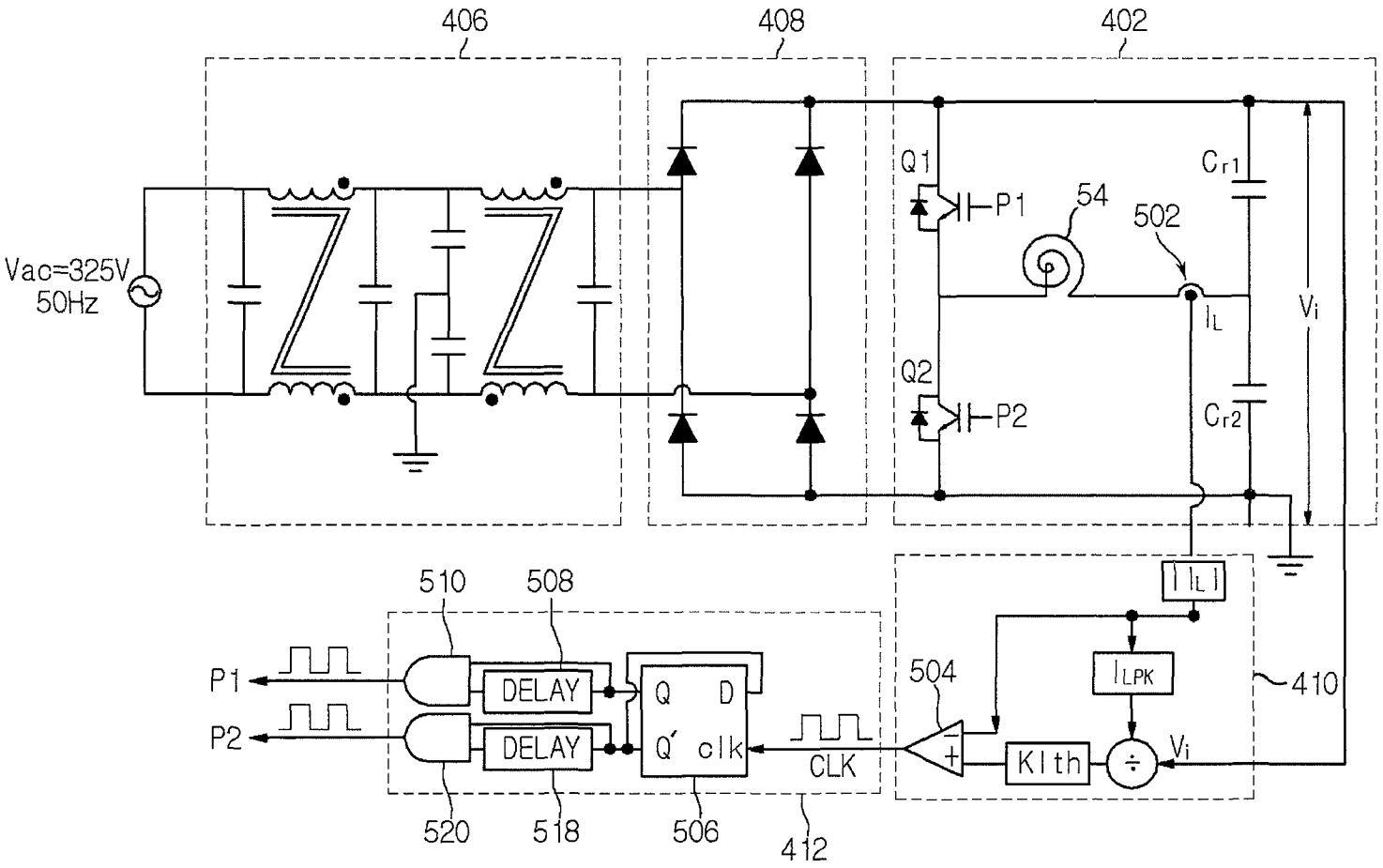
FIG. 5 is a circuit diagram of the high frequency power supply of FIG. 4.

FIG. 5 is a circuit diagram of the high frequency power supply of FIG. 4. Referring to FIG. 5, the filter unit 406 may include transformers and capacitors and may cancel noise mixed into the power being supplied from the AC power source 404. The rectifier 408 may constitute a bridge rectifier circuit of multiple diodes. The AC power output from the filter unit 406 may be rectified into DC power by rectification of the multiple diodes of the rectifier 408.

The inverter unit 402 may be based on a half-bridge circuit including multiple switching devices Q1 and Q2 and multiple capacitors $C_{r1}$ and $C_{r2}$. The switching devices Q1 and Q2 may be turned on or turned off by the switch driving signals P1 and P2 generated by the switch driver 412. The switching devices Q1 and Q2 may be Insulated Gate Bipolar Transistors (IGBTs). In the inverter unit 402, input voltage $V_i$ may be equally divided by the capacitors $C_{r1}$ and $C_{r2}$ with approximately the same capacitance and the divided voltage $V_i/2$ appears across each of the capacitors $C_{r1}$ and $C_{r2}$. Feedback diodes may be connected across the switching devices Q1 and Q2 to have current continuously flow in an inductive load. Alternately turning on and off the switching devices Q1 and Q2 in the inverter unit 402 may enable certain frequency AC current to flow in the coil 54. A current sensor 502 may be located in a current path between the coil 54 and the capacitors $C_{r1}$ and $C_{r2}$. The current sensor 502 may detect a magnitude of the current flowing in the coil 54, i.e., coil current $I_L$. Information about the coil current $I_L$ (e.g., information about the magnitude of the coil current $I_L$) may be provided to the resonance point tracking controller 410. Furthermore, information about the voltage applied to the coil 54 (e.g., information about the input voltage V, across the two capacitors $C_{r1}$ and $C_{r2}$ in series) may be applied to the resonance point tracking controller 410.

In the inverter unit 402, a frequency of the high frequency current applied to the coil 54 may be fixed or have a particular value according to user settings. Since the frequency of the high frequency current determines strength of magnetic fields around the coil 54 and an inductive current is created in proportion to the strength of the magnetic fields, a heating value in the cooking vessel 52 may be finally determined in proportion to the frequency of the high frequency current applied to the coil 54.

The resonance point tracking controller 410 may control a comparator 504 (or called a first comparator) to compare the information about the coil current $I_L$ with the information about the input voltage $V_i$, and generate a clock signal CLK with a frequency determined by the comparison. An absolute value of the coil current $I_L$ input to the resonance point tracking controller 410 may be input to an inverting input (−) of the comparator 504. A threshold current $I_{th}$ (or called a first threshold current) may be input to a non-inverting input (+) of the comparator 504. Accordingly, if the absolute value of the coil current $I_L$ is greater than the threshold current $I_{th}$, a low level of the clock signal CLK may be output from the comparator 504, forming a low level interval; and otherwise if the absolute value of the coil current $I_L$ is less than or equal to the threshold current $I_{th}$, a high level of the clock signal CLK may be output from the comparator 504, forming a high level interval. The threshold current $I_{th}$ input to the non-inverting input (+) of the comparator 504 may be determined by a peak value $I_{LPK}$ of the coil current $I_L$ divided by the input voltage $V_i$, i.e., $I_{LPK}/V_i$. A value resulting from multiplication of the threshold current $I_{th}$ by a proportional factor K may be input to the non-inverting input (+) of the comparator 504. Detailed operations of the resonance point tracking controller 410 may be discussed later in connection with FIG. 8.

The switch driver 412 may generate multiple switch driving signals P1 and P2 by dividing the clock signal CLK generated by the resonance point tracking controller 410. The multiple switch driving signals P1 and P2 may turn on or turn off the switching devices Q1 and Q2 of the inverter unit 402 as discussed above. The clock signal CLK generated by the resonance point tracking controller 410 may be input to a D flip-flop 506 of the switch driver 412 as a clock signal. A logic Input D of the D flip-flop 506 is connected to a negative logic output Q' of the D flip-flop 506. The frequency of the clock signal CLK generated by the resonance point tracking controller 410 may be divided by 2. A positive logic signal output from a positive logic output Q of the D flip-flop 506 may go through a delay circuit 508 and an AND gate 510 and be output as the switch driving signal P1 to turn on or turn off the switching device Q1, and a negative logic signal output from a negative logic output Q' of the D flip-flop 506 may go through a delay circuit 518 and an AND gate 520 and be output as the switch driving signal P2 to turn on or turn off the switching device Q2. Due to the work of the D flip-flop 506, the two switch driving signals P1 and P2 have opposite phases. Due to the work of the delay circuits 508 and 518, dead time may occur between the two switch driving signals P1 and P2, which prevents overlapping of the two switch driving signals P1 and P2, thereby avoiding a situation where the two switching devices Q1 and Q2 of the inverter unit 402 are turned on at the same time.

Figure 6:
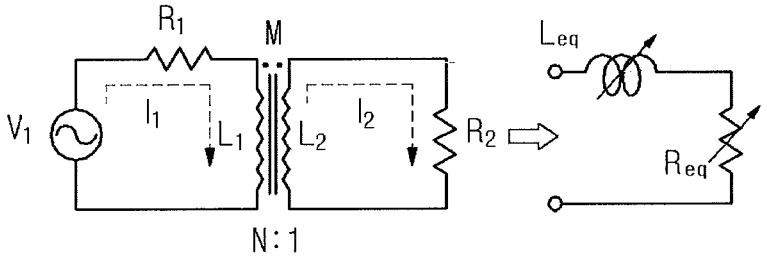
FIG. 6 is an equivalent circuit of the induction heating cooker of FIG. 1.

FIG. 6 is an equivalent circuit of the induction heating cooker of FIG. 1. The induction heating cooker may be represented with a transformer equivalent model having the coil 54 and a load, e.g., the cooking vessel 52 for a primary side and a secondary side, respectively. As shown in FIG. 6, the equivalent model may be represented with equivalent inductance Leq and equivalent resistance Req in series. The equivalent circuit may be expressed in equation 1 as follows:

$$V_1=(R_1+jwL_1)I_1-jwMI_2$$

$$0=-jwMI_1+(R_2+jwL_2)I_2 \quad (1)$$

In equation 1, M refers to mutual inductance. With respect to $I_2$, equation 1 may be re-arranged into equation 2 as follows:

$$I_2 = \frac{jwMI_1}{R_2 + jwL_2} \quad (2)$$

By equations 1 and 2, parameters of the equivalent circuit may be expressed in equation 3 as follows:

$$\frac{V_1}{I_1} = R_{eq} + jwL_{eq} \quad (3)$$

The equivalent parameters Leq and Req may vary with size and location of a load for heating (e.g., the cooking vessel 52), a distance between the coil 54 and the load, conductivity and permeability of the load, operating frequency, etc. To control current of the coil 54 that is robust to variation of the parameters Leq and Req, a switching frequency Fsw of the switching device Q2 may be higher than a resonance frequency Fr. To control current of the coil 54 that is robust to variation of the parameters Leq and Req, a phase difference ϕ between the voltage and the current applied to the coil 54 may be great. However, the greater the phase difference ϕ becomes, the greater the turn-off current $I_{off}$ of the switching devices Q1 and Q2 becomes, thereby increasing switching losses.

Figure 7:
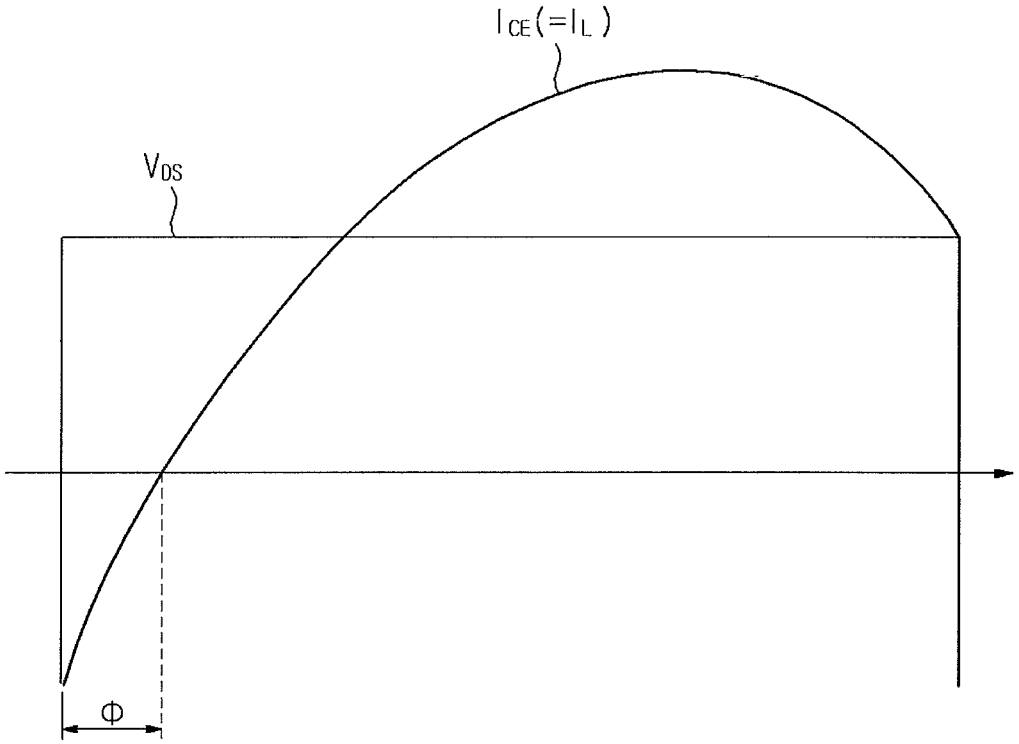
FIG. 7 illustrates a switching current curve at a high frequency power supply circuit of the induction heating cooler of FIG. 1.

FIG. 7 illustrates a switching current curve at a high frequency power supply circuit of the induction heating cooler of FIG. 1. Referring to FIG. 7, when the switching devices Q1 and Q2 are repeatedly turned on and turned off, the greater the phase difference ϕ between a drain-source voltage $V_{DS}$ and a collector-emitter current ($I_{CE}$, which is the same as the coil current $I_L$) of the switching devices Q1 and Q2, the greater the switching loss. Accordingly, the embodiment of the present disclosure aims at minimizing the phase difference $\phi$ between the voltage and the current to minimize the switching loss.

Figure 8:
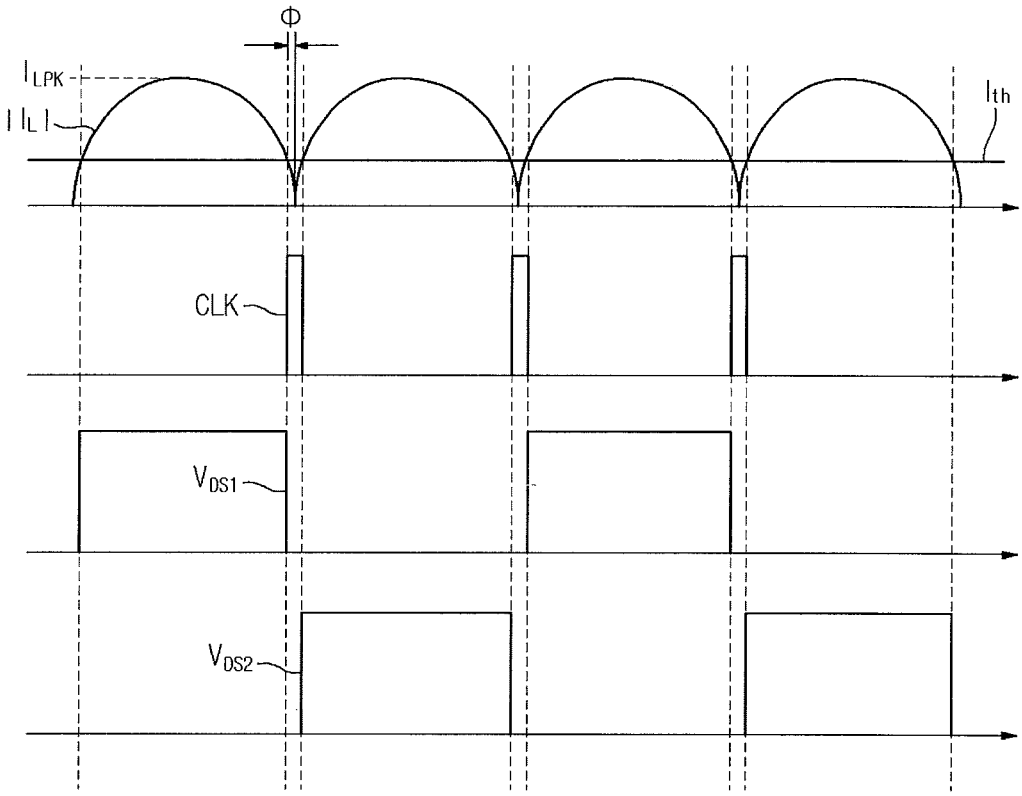
FIG. 8 illustrates operations of a resonance point tracking controller as shown in FIG. 5.

FIG. 8 illustrates operations of the resonance point tracking controller 410 as shown in FIG. 5. Turning back to FIG. 5, a configuration of the resonance point tracking controller 410 of the induction heating cooker has been described. FIG. 8 illustrates how the resonance point tracking controller 410 minimizes the phase difference $\phi$.

Referring to FIG. 8, intervals where the absolute value of the coil current $I_L$ is greater than the threshold current $I_{th}$ may correspond to low level intervals of the clock signal CLK, while intervals where the absolute value of the coil current $I_L$ is equal to or less than the threshold current $I_{th}$ correspond to high level intervals of the clock signal CLK. It may be seen that the phase difference $\phi$ between the drain-source voltage $V_{DS1}$ or $V_{DS2}$ and the coil current $I_L$ of the switching devices Q1 and Q2 decreases because the less the threshold current $I_{th}$, the shorter the high level interval. It is desirable to set the threshold current $I_{th}$ to be proportional to $I_{LPK}/V_i$ so as to keep the turn-off current for the switching devices Q1 and Q2 minimum. Here, $I_{LPK}$ refers to a peak value of the coil current $I_L$ and $V_i$ refers to an input voltage.

Figure 9:
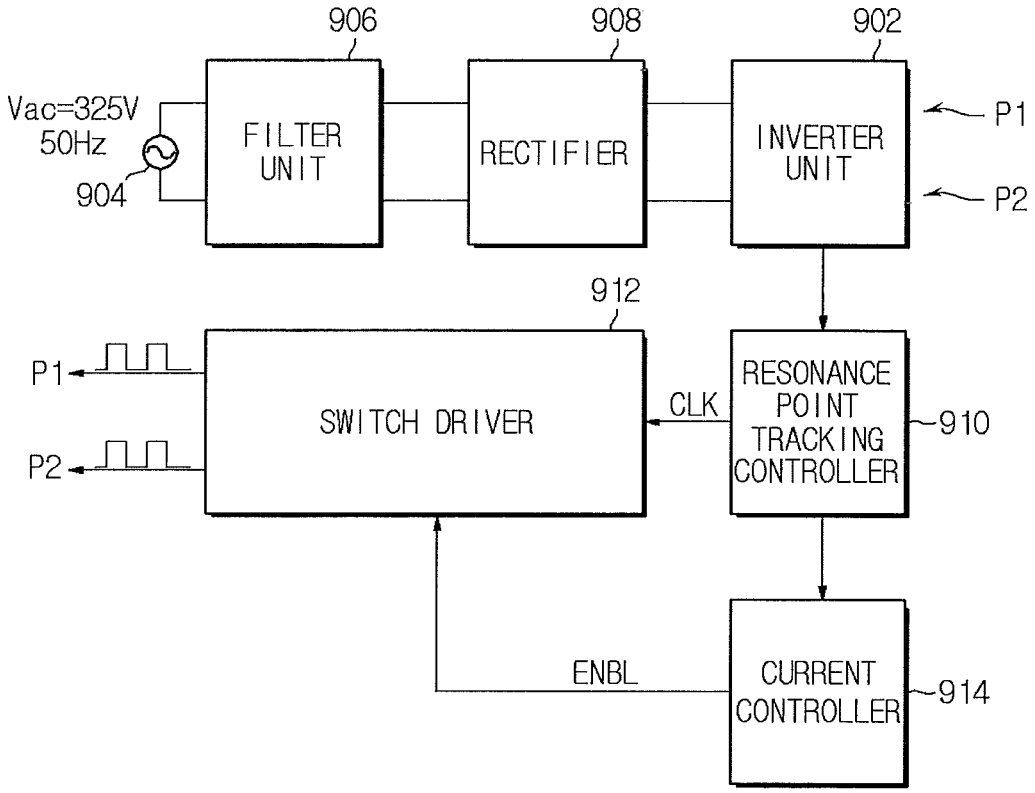
FIG. 9 is a block diagram of a high frequency power supply of the induction heating cooler of FIG. 1, according to another embodiment of the present disclosure.

FIG. 9 is a block diagram of a high frequency power supply of the induction heating cooler of FIG. 1, according to another embodiment of the present disclosure. Referring to FIG. 9, an inverter unit 902 may include the coil 54 as shown in FIGS. 2 and 3. When AC power from an AC power source 904 is supplied to the coil 54 of the inverter unit 902 through a filter unit 906 and a rectifier 908, a resonance point tracking controller 910 (or called a 'first controller'), a current controller 914 (or called a 'second controller'), and a switch driver 912 may be involved in supplying power to the inverter unit 902 in order to minimize a power loss that is likely to occur in the inverter unit 902.

As shown in FIG. 9, the AC power source 904 may supply common AC power with e.g., a voltage of 325V and a frequency of 50 Hz. The common AC power supplied from the AC power source 904 may go through noise cancellation in the filter unit 906, and then delivered to the rectifier 908. The rectifier 908 may rectify the AC power to DC power, and the DC power is delivered to the inverter unit 902. The inverter unit 902 may convert the DC power to high frequency (AC) power by switching operations, and the high frequency power is applied to the coil 54.

The resonance point tracking controller 910 may control the switch driver 912 to minimize the power loss by optimizing the switching operations for supplying power to the coil 54 even if some electrical parameters (e.g., equivalent inductance and equivalent resistance) of the coil 54 change. The switch driver 912 may generate and provide switch driving signals P1 and P2 for the inverter unit 902 to perform switching operations. The inverter unit 902 may perform the switching operations with the switch driving signals P1 and P2.

The current controller 914 is to control an average current in the coil 54 through low frequency switching operations of Pulse Width Modulation (PWM). Specifically, the current controller 914 may receive information about an absolute value (magnitude) of the coil current $I_L$ from the resonance point tracking controller 910 and then generate an enable (EN) signal that enables the clock signal CLK output from the resonance point tracking controller 910 to be input to the switch driver 912.

Figure 10:
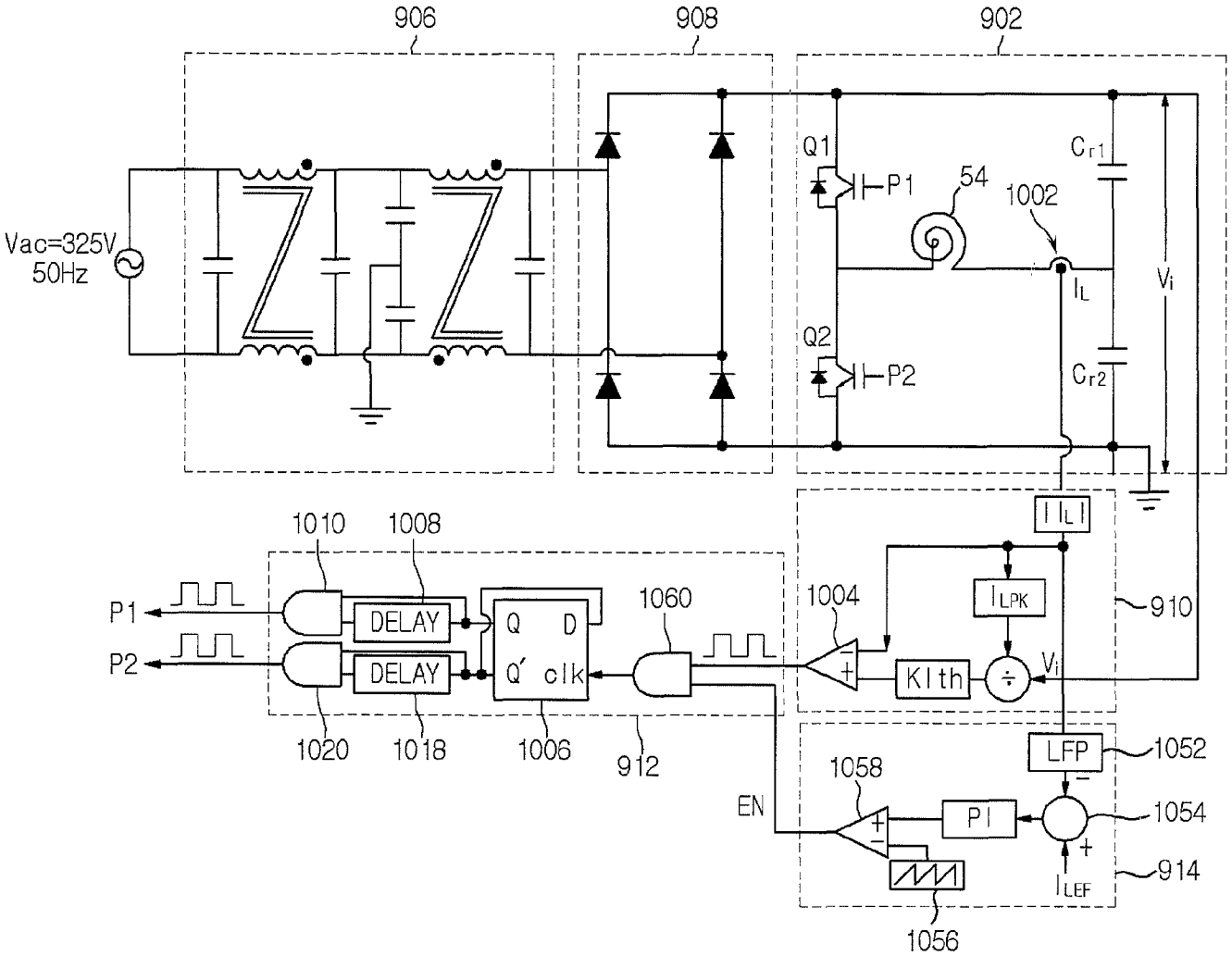
FIG. 10 is a circuit diagram of the high frequency power supply of FIG. 9.

FIG. 10 is a circuit diagram of the high frequency power supply of FIG. 9. Referring to FIG. 10, the filter unit 906 may include transformers and capacitors and may cancel noise mixed into the power being supplied from the AC power source 904. The rectifier 908 may constitute a bridge rectifier circuit of multiple diodes. The AC power output from the filter unit 906 may be rectified into DC power by rectification of the multiple diodes of the rectifier 908.

The inverter unit 902 may be based on a half-bridge circuit including multiple switching devices Q1 and Q2 and multiple capacitors $C_{r1}$ and $C_{r2}$. The switching devices Q1 and Q2 may be turned on or turned off by the switch driving signals P1 and P2 generated by the switch driver 912. The switching devices Q1 and Q2 may be Insulated Gate Bipolar Transistors (IGBTs). In the inverter unit 902, input voltage V; may be equally divided by the capacitors $C_{r1}$ and $C_{r2}$ with approximately the same capacitance and the divided voltage $V_i/2$ appears across each of the capacitors $C_{r1}$ and $C_{r2}$. Feedback diodes may be connected across the switching devices Q1 and Q2 to have current continuously flow in an inductive load. Alternately turning on and off the switching devices Q1 and Q2 in the inverter unit 902 may enable certain frequency AC current to flow in the coil 54. A current sensor 1002 may be located in a current path between the coil 54 and the capacitors $C_{r1}$ and $C_{r2}$. The current sensor 1002 may detect a magnitude of the current flowing in the coil 54, i.e., coil current $I_L$. Information about the coil current $I_L$ (e.g., information about the magnitude of the coil current $I_L$) may flow to the resonance point tracking controller 910. Furthermore, information about the voltage applied across the coil 54 (e.g., information about the input voltage $V_i$ across two capacitors $C_{r1}$ and $C_{r2}$ in series) may be applied to the resonance point tracking controller 910.

In the inverter unit 902, a frequency of the high frequency current applied to the coil 54 may be fixed or have a particular value according to user settings. Since the frequency of the high frequency current determines strength of magnetic fields around the coil 54 and an inductive current is created in proportion to the strength of the magnetic fields, a heating value in the cooking vessel 52 may be finally determined in proportion to the frequency of the high frequency current applied to the coil 54.

The resonance point tracking controller 910 may control a comparator 1004 (or called a first comparator) to compare the information about the coil current $I_L$ with the information about the input voltage $V_i$, and generate a clock signal CLK with a frequency determined by the comparison. An absolute value of the coil current $I_L$ input to the resonance point tracking controller 910 may be input to an inverting input (−) of the comparator 1004. A threshold current $I_{th}$ (or called a first threshold current) may be input to a non-inverting input (+) of the comparator 1004. Accordingly, if the absolute value of the coil current $I_L$ is greater than the threshold current $I_{th}$, a low level of the clock signal CLK may be output from the comparator 1004, forming a low level interval; and otherwise if the absolute value of the coil current $I_L$ is less than or equal to the threshold current $I_{th}$, a high level of the clock signal CLK may be output from the comparator 504, forming a high level interval. The threshold current $I_{th}$ input to the non-inverting input (+) of the comparator 1004 may be determined by a peak value $I_{LPK}$ of the coil current $I_L$ divided by the input voltage $V_i$, i.e., $I_{LPK}/V_i$. A value resulting from multiplication of the threshold current $I_{th}$ by a proportional factor K may be input to the non-inverting input (+) of the comparator 1004. Detailed operations of the resonance point tracking controller 910 may be discussed later in connection with FIG. 11.

The current controller 914 may receive information about an absolute value (magnitude) of the coil current $I_L$ from the resonance point tracking controller 910 and a reference current $I_{LREF}$ (or called a second threshold current), perform Proportional Integral (PI) control over a difference between the absolute value of the coil current $I_L$ and the reference current $I_{LREF}$, and ensure that a PI control value $P_{ref}$ resulting from the PI control is input to the non-inverting input (+) of a comparator 1058 (or called a second comparator). Low frequency (e.g., 1 Hz) sawtooth waves 1056 may be input to the inverting input (−) of the comparator 1058. Here, the reference current $I_{LREF}$ refers to a current value that represents a target output of the induction heating cooker set by the user. The current controller 914 may generate a pulse signal as an enable (EN) signal having a high level value in an interval where the PI control value $P_{ref}$ is greater than the sawtooth wave and a low level value in an interval where the PI control value Pref is equal to or less than the sawtooth wave. The enable signal EN may be input to an AND gate 1060 of the switch driver 912.

The switch driver 912 may generate multiple switch driving signals P1 and P2 by dividing the clock signal CLK generated by the resonance point tracking controller 910. The multiple switch driving signals P1 and P2 may turn on or turn off the switching devices Q1 and Q2 of the inverter unit 902 as discussed above. The clock signal CLK generated by the resonance point tracking controller 910 may also be input to the AND gate 1060 of the switch driver 912. Thus, the clock signal CLK and the enable signal EN may be input signals for the AND gate 1060. For the high level interval of the enable signal EN, the intact clock signal CLK is output from the AND gate 1060; and for the low level interval of the enable signal EN, only a low level signal may be output from the AND gate 1060. After all, it may be seen that the enable signal EN enables the clock signal CLK output from the resonance point tracking controller 910 to be selectively sent to a D-flip-flop 1006 of the switch driver 912. The output signal from the AND gate 1060 may be a clock signal for the D flip-flop 1006. A logic Input D of the D flip-flop 1006 is connected to a negative logic output Q' of the D flip-flop 1006. The frequency of the clock signal CLK generated by the resonance point tracking controller 910 (more specifically, the frequency of a signal output from the AND gate 1060) may be divided by 2. A positive logic signal output from a positive logic output Q of the D flip-flop 1006 may go through a delay circuit 1008 and an AND gate 1010 and be output as the switch driving signal P1 to turn on or turn off the switching device Q1, and a negative logic signal output from a negative logic output Q' of the D flip-flop 1006 may go through a delay circuit 1018 and an AND gate 1020 and be output as the switch driving signal P2 to turn on or turn off the switching device Q2. Due to the work of the D flip-flop 1006, the two switch driving signals P1 and P2 have opposite phases. Due to the operation of the delay circuits 1008 and 1018, dead time may occur between the two switch driving signals P1 and P2, which prevents overlapping of the two switch driving signals P1 and P2, thereby avoiding a situation where the two switching devices Q1 and Q2 of the inverter unit 902 are turned on at the same time.

Figure 11:
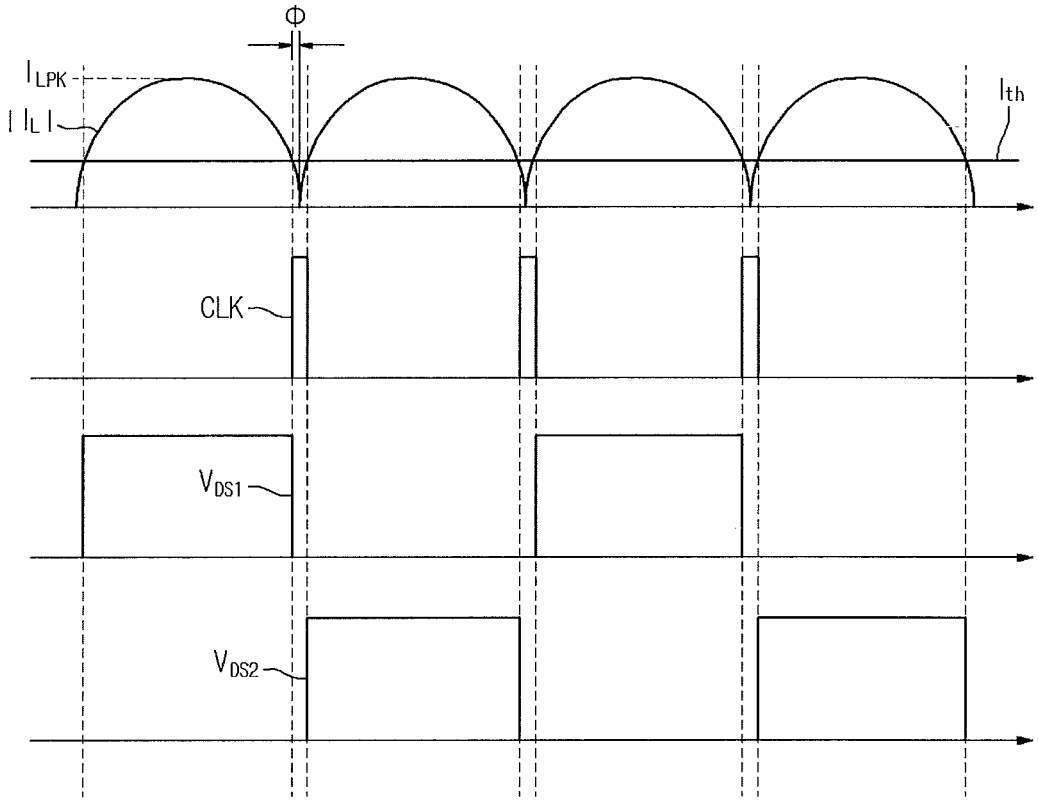
FIG. 11 illustrates operations of a resonance point tracking controller as shown in FIG. 10.

FIG. 11 illustrates operations of the resonance point tracking controller 910 as shown in FIG. 10. Turning back to FIG. 10, configuration of the resonance point tracking controller 910 of the induction heating cooker has been described. FIG. 11 illustrates how the resonance point tracking controller 910 minimizes the phase difference ϕ.

Referring to FIG. 11, intervals where the absolute value of the coil current $I_L$ is greater than the threshold current $I_{th}$ may correspond to low level intervals of the clock signal CLK, while intervals where the absolute value of the coil current $I_L$ is equal to or less than the threshold current $I_{th}$ correspond to high level intervals of the clock signal CLK. It may be seen that the phase difference ϕ between the drain-source voltage $V_{DS1}$ or $V_{DS2}$ and the coil current $I_L$ of the switching devices Q1 and Q2 decreases because the less the threshold current $I_{th}$, the shorter the high level interval. It is desirable to set the threshold current $I_{th}$ to be proportional to $I_{LPK}/V_i$ so as to keep the turn-off current for the switching devices Q1 and Q2 minimum. Here, $I_{LPK}$ refers to a peak value of the coil current $I_L$ and $V_i$ refers to an input voltage.

Figure 12:
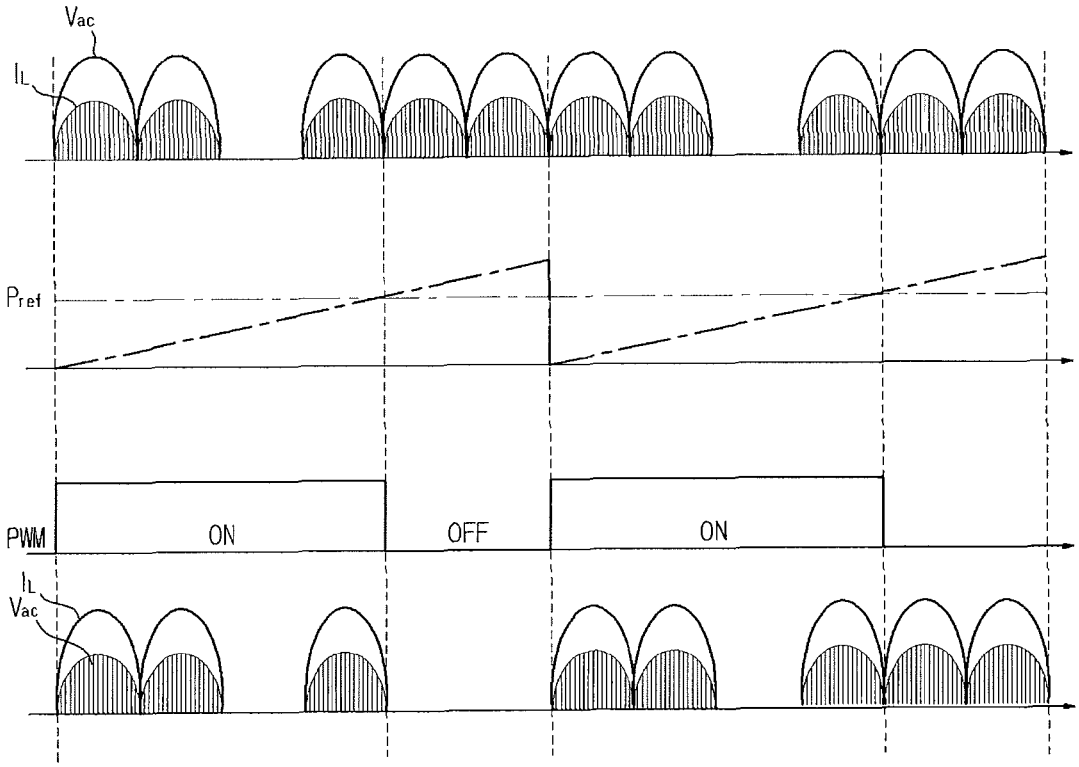
FIG. 12 illustrates operations of a current controller as shown in FIG. 9.

FIG. 12 illustrates operations of the current controller 914 as shown in FIG. 9. Referring to FIG. 12, the current controller 914 may compare a PI control value $P_{ref}$ resulting from PI control with a low frequency (e.g., about 1 Hz) sawtooth wave 1056, and generate a pulse signal as an enable (EN) signal having a high level value in an interval where the PI control value Pref is greater than the sawtooth wave and a low level value in an interval where the PI control value $P_{ref}$ is equal to or less than the sawtooth wave. The switch driver 912 may ensure that the voltage $V_i$ and the coil current are applied to the coil 54 only in high level intervals of the enable signal EN, as shown in the bottom of FIG. 12, by turning on and off the switching devices Q1 and Q2 with the switch driving signals P1 and P2 generated by dividing the clock signal CLK only in the high level interval of the enable signal EN. After all, it may be seen that quantities of the voltage $V_i$ and the coil current $I_L$ may depend on the size of the high level interval (i.e., the pulse width) of the enable signal EN.

If the magnitude of the reference current $I_{LREF}$ is large and thus leads to increase in the PI control value $P_{ref}$, the width of the high level interval of the enable signal becomes larger and thus greater voltage $V_i$ and coil current $I_L$ may be applied to the coil 54; but otherwise, if the magnitude of the reference current $I_{LREF}$ is small and thus leads to decrease in the PI control value $P_{ref}$, the width of the high level interval of the enable signal becomes smaller and thus relatively less magnitude of voltage $V_i$ and coil current $I_L$ may be applied to the coil 54. As such, it may be seen that quantities of the voltage $V_i$ and the coil current $I_L$ to be applied to the coil 54 are controlled based on the quantity of the reference current $I_{LREF}$ that represents the target output set by the user while the frequency of the voltage $V_i$ and the coil current $I_L$ remains the same. While the plurality of coils 54 of the induction heating cooker are operating, if respective frequencies of the coils 54 are different, the difference in those frequencies may cause noise. The embodiments of the present disclosure may have an effect of noise reduction by controlling only conducting intervals by pulse width control as shown in FIG. 12 while keeping the frequency of the voltage $V_i$ and the coil current $I_L$ for each of the plurality of coils 54 intact.

Several embodiments have been described in connection with e.g., mobile communication terminals, but a person of ordinary skill in the art will understand and appreciate that various modifications can be made without departing the scope of the present disclosure. Thus, it will be apparent to those ordinary skilled in the art that the disclosure is not limited to the embodiments described, which have been provided only for illustrative purposes.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An induction heating apparatus comprising:

a coil;

an inverter unit configured to have a switching device turned on and off to supply power to the coil;

a controller configured to generate a threshold current based on information about a coil current flowing in the coil and an input voltage applied to the coil, and to generate a clock signal by comparing the coil current with the threshold current; and a switch driver configured to generate a switch driving signal to turn on or off the switching device of the inverter unit by dividing a frequency of the clock signal, wherein the threshold current is determined to be proportional to a peak value of the coil current divided by the input voltage applied to the coil.

2. The induction heating apparatus of claim 1, wherein higher level intervals of the clock signal are formed in intervals where the coil current is less than the threshold current.

3. The induction heating apparatus of claim 1, wherein the controller comprises a comparator, and wherein the comparator includes magnitude information of the coil current input at an inverting input of the comparator and includes the threshold current input at a non-inverting input of the comparator.

4. The induction heating apparatus of claim 3, wherein the threshold current is determined to have a magnitude to keep a turn-off current of the switching device minimum.

5. The induction heating apparatus of claim 1, wherein the switch driver comprises a D flip-flop having:

the clock signal input to a clock input of the D flip-flop, and a negative logic output connected to a data input of the D flip-flop; and a logic gate configured to generate a switch driving signal to drive the switching device of the inverter unit using a positive logic output and the negative logic output of the D flip-flop.

6. The induction heating apparatus of claim 5, wherein the logic gate comprises an AND gate for generating the switch driving signal by dividing a frequency of the positive logic output of the D flip-flop approximately by two.

7. The induction heating apparatus of claim 1, wherein the inverter unit comprises a half-bridge inverter.

8. The induction heating apparatus of claim 1, wherein the controller and the switch driver constitute a half-bridge inverter implemented by a microcomputer.

9. An induction heating apparatus comprising:

a coil;

an inverter unit configured to have a switching device turned on and off to supply power to the coil;

a first controller configured to generate a first threshold current based on information about a coil current flowing in the coil and an input voltage applied to the coil, and to generate a clock signal by comparing the coil current with the first threshold current;

a switch driver configured to generate a switch driving signal to turn on or off the switching device of the inverter unit by dividing a frequency of the clock signal; and a second controller configured to generate an enable signal for selectively restricting input of the clock signal to the switch driver based on output information set by a user, when the clock signal output from the first controller is input to the switch driver, wherein the first threshold current is determined to be proportional to a peak value of the coil current divided by the input voltage applied to the coil.

10. The induction heating apparatus of claim 9, wherein higher level intervals of the clock-signal are formed in intervals where the coil current is less than the first threshold current.

11. The induction heating apparatus of claim 9, wherein the first controller comprises a first comparator, and wherein the first comparator includes magnitude information of the coil current input at an inverting input of the comparator and includes the first threshold current input at a non-inverting input of the comparator.

12. The induction heating apparatus of claim 11, wherein the first threshold current is determined to have a magnitude to keep a turn-off current of the switching device minimum.

13. The induction heating apparatus of claim 9, wherein the switch driver comprises a D flip-flop having:

the clock signal input to a clock input of the D flip-flop and a negative logic output connected to a data input of the D flip-flop; and a logic gate configured to generate a switch driving signal to drive the switching device of the inverter unit using a positive logic output and the negative logic output of the D flip-flop.

14. The induction heating apparatus of claim 13, wherein the logic gate comprises an AND gate for generating the switch driving signal by dividing a frequency of the positive logic output of the D flip-flop approximately by two.

15. The induction heating apparatus of claim 9, wherein the inverter unit comprises a half-bridge inverter.

16. The induction heating apparatus of claim 9, wherein the second controller comprises a second comparator, and wherein the second comparator has a Proportional Integral (PI) control value resulting from PI control over a difference between an absolute value of the coil current and a second threshold current at its non-inverting input, and has a sawtooth wave signal at its non-inverting input.

17. The induction heating apparatus of claim 16, wherein the second threshold current represents a target output of the induction heating device set by a user.

18. The induction heating apparatus of claim 16, wherein the second controller generates a pulse signal as the enable signal having a higher level value for intervals where the PI control value is greater than the sawtooth wave signal and a lower level value for intervals where the PI control value is equal to or less than the sawtooth wave signal.

19. The induction heating apparatus of claim 18, wherein a frequency of the clock signal is divided in the switch driver in the higher level intervals of the enable signal.

20. The induction heating apparatus of claim 9, wherein the first controller, the switch driver, and the second controller constitute a half-bridge inverter implemented by a microcomputer.

21. An induction heating cooker, comprising:

a coil;

an inverter unit configured to have a switching device turned on and off to supply power to the coil;

a controller configured to generate a threshold current based on information about a coil current flowing in the coil and an input voltage applied to the coil, and to generate a clock signal by comparing the coil current with the threshold current; and a switch driver configured to generate a switch driving signal to turn on or off the switching device of the inverter unit by dividing a frequency of the clock signal wherein the threshold current is determined to be proportional to a peak value of the coil current divided by the input voltage applied to the coil.

* * * * *